US005837923A

United States Patent [19]

Gay et al.

[11] Patent Number: 5,837,923

[45] Date of Patent: Nov. 17, 1998

[54] TRANSFER DEVICE FOR TRANSFERRING MODULES CONSTITUTING PROPELLANT CHARGES BETWEEN A STORAGE MAGAZINE AND A SYSTEM FOR LOADING THE MODULES INTO THE CHAMBER OF A LARGE-CALIBER GUN BARREL

[75] Inventors: Christian Gay, La-Chapelle-Saint-Ursin; Christophe Nicolas, Bourges; François Roger, Le Subdray; Laurent Le Grand, Mehun-Sur-Yevre; Bernard Petit, Bourges; Didier Thebault, Bourges; Jean-Luc Pelissier, Bourges, all of France

[73] Assignee: Giat Industries, Versailles, France

[21] Appl. No.: 778,476

[22] Filed: Jan. 3, 1997

[30] Foreign Application Priority Data

Jan. 5, 1996 [FR] France ..... 96 00072

[51] Int. Cl.[6] ..... F41A 9/48

[52] U.S. Cl. ..... 89/46; 89/45

[58] Field of Search ..... 89/45, 46, 47, 89/33.04, 33.05; 102/705

[56] References Cited

U.S. PATENT DOCUMENTS

| | | | |
|---|---|---|---|
| H592 | 3/1989 | Gillum | 89/46 |
| 5,111,730 | 5/1992 | Grabner | 89/45 |
| 5,111,731 | 5/1992 | Grabner | 89/46 |
| 5,175,388 | 12/1992 | Maher et al. | 89/35.01 |
| 5,289,754 | 3/1994 | Elspass | 89/46 |

FOREIGN PATENT DOCUMENTS

| | | | |
|---|---|---|---|
| 157111 | 10/1985 | European Pat. Off. . | |
| 521722 | 1/1993 | European Pat. Off. . | |
| 3294793 | 12/1991 | Japan | 89/47 |
| 2207738 | 2/1989 | United Kingdom . | |

*Primary Examiner*—Stephen M. Johnson
*Attorney, Agent, or Firm*—Bell Seltzer Intellectual Property Law Group Alston & Bird LLP

[57] ABSTRACT

Apparatus for transferring modules (3) that make up propellant charges from a storage magazine to a loading system (5) for loading the modules into the chamber of a large-caliber gun barrel, in particular a barrel mounted in a turret or in an armored casemate, said apparatus being characterized in that it includes: first means (6) for receiving n modules (3) taken from a magazine; second means (7) for transferring each of the n modules (3) to a conveyor (8) of a loading system (5); and control apparatus (9) for controlling the second means (7) so as to select transferal of a determined number of modules (3) to the conveyor (8) as a function of the quantity of modules (3) making up the desired propellant charge for firing a projectile.

18 Claims, 5 Drawing Sheets

TRANSFER DEVICE FOR TRANSFERRING MODULES CONSTITUTING PROPELLANT CHARGES BETWEEN A STORAGE MAGAZINE AND A SYSTEM FOR LOADING THE MODULES INTO THE CHAMBER OF A LARGE-CALIBER GUN BARREL

BACKGROUND OF THE INVENTION

The present invention relates to apparatus for transferring modules that make up propellant charges from a storage magazine to a system for loading the modules into the chamber of a large-caliber gun barrel, in particular a barrel mounted in a turret or in an armored casemate.

In general, when the ammunition fired by a large-caliber gun barrel comprises a projectile and a propellant charge that are inserted successively into the chamber of the barrel, the charge is made up of a consumable cylindrical case of fixed length, the case enclosing bags of propellant powder, the number of which varies depending on the quantity of powder required to fire the projectile.

Currently, the trend is to replace such a single fixed-length case with a plurality of cylindrical modules all of identical size, each of which contains a determined quantity of propellant powder, and the number of which varies depending on the quantity of powder required to fire the projectile.

This results in propellant charges of various lengths.

Under such conditions, magazines for storing and feeding propellent charges, and semi-automatic or automatic systems for loading a propellant charge into the chamber of a gun must now take account of the fact that the propellant charge required to fire a projectile is no longer of fixed length.

It is known that the volume inside a magazine for storing and feeding modules that make up propellant charges can be compartmentalized so as to store a plurality of rows of modules in each compartment, each row containing n modules that are in axial alignment along the axis of the row, and it is also known that moving means can be used to grasp automatically all of the modules in the same row of a compartment of the magazine, and to transfer them to the loading system which must also be capable of managing the number of modules to be conveyed to the chamber of the gun to fire the projectile.

An object of the invention is to design apparatus for transferring such modules from a storage magazine of the above-mentioned type to a system for loading the modules into the chamber of a large-caliber gun barrel, which apparatus makes it possible to,manage the number of modules to be conveyed to the chamber of the gun.

SUMMARY OF THE INVENTION

The invention thus provides apparatus for transferring modules that make up propellant charges from a storage magazine to a loading system for loading the modules into the chamber of a large-caliber gun barrel, in particular a barrel mounted in a turret or in an armored casemate, said apparatus being characterized in that it includes:

first means for receiving n modules taken from a magazine;

second means for transferring each of the n modules to a conveyor of the loading system; and control apparatus for controlling the second means so as to select transferal of a determined number of modules to the conveyor as a function of the quantity of modules making up the desired propellant charge for firing a projectile.

In a first embodiment of the invention, the first means comprise a set of n compartments, and, at each compartment, the second means comprise an abutment surface carried by a flap mounted to pivot and to be displaced by means of an actuator between an active position in which it retains the module and a retracted position in which it releases the module which falls by gravity onto the conveyor.

Advantageously, the compartments for receiving the modules are disposed in a row, and the conveyor comprises a trough disposed beneath the row of compartments and parallel thereto.

In a second embodiment of the invention, the first 35 means comprise a set of n compartments, and, at each compartment, the second means comprise a pusher that can be moved in translation in a first direction which is perpendicular to the axis of the module so as to push said module into the conveyor.

Advantageously, at each compartment, the apparatus includes side chocking means for chocking each charge module in a first direction that is perpendicular to the axis of the module, which means comprise at least one retractable finger disposed between the module and the conveyor, and moved out of the way by displacing the pusher.

At each compartment, the apparatus may also include means for holding each charge module in a second direction perpendicular both to the axis of the module and to the first direction, which means comprise at least one first retractable tab which is moved out of the way by the module as it enters the compartment and which is returned to the holding position by the action of spring means.

The apparatus may include means for holding each module in the conveyor, which means comprise at least one second retractable tab disposed between each compartment and the conveyor, which tab is moved out of the way by the module as it enters the conveyor, and is returned to its holding position under the action of spring means.

Advantageously, the compartments for receiving the modules are disposed in a row, and the conveyor comprises a trough disposed on one side of the row of compartments and parallel thereto.

The compartments and the trough may be secured to a common support structure.

In general, the conveyor also includes a ramrod for pushing the modules received in the trough towards the cradle of an arm for loading the modules into the chamber of the barrel.

Advantageously, the conveyor comprises means for separating the modules received in the trough from one another, which means can be retracted prior to actuating the ramrod.

By way of example, the separation means are constituted by a comb extending parallel to the trough, the teeth of the comb separating the modules.

The compartments are advantageously provided in a longitudinal unit, and they are delimited by a set of end partitions.

In general, the control apparatus for controlling the second means comprises a central processing unit for controlling the actuator of each compartment as a function of the quantity of modules making up the desired propellant charge, and means for counting the number of modules transferred to the conveyor.

One advantage of the invention is that the transfer apparatus is simple in design, and is easy to integrate into the volume dedicated for this purpose in a turret or an armored casemate.

Another advantage of the invention is that the transfer apparatus can be easily integrated into an automatic feed system for feeding modules making up propellant charges to the chamber of the barrel.

Other advantages, characteristics, and details of the invention appear from the following explanatory description given with reference to the accompanying drawings which are given by of example, and in which:

DESCRIPTION OF THE PREFERRED EMBODIMENT(s)

Figure 1:
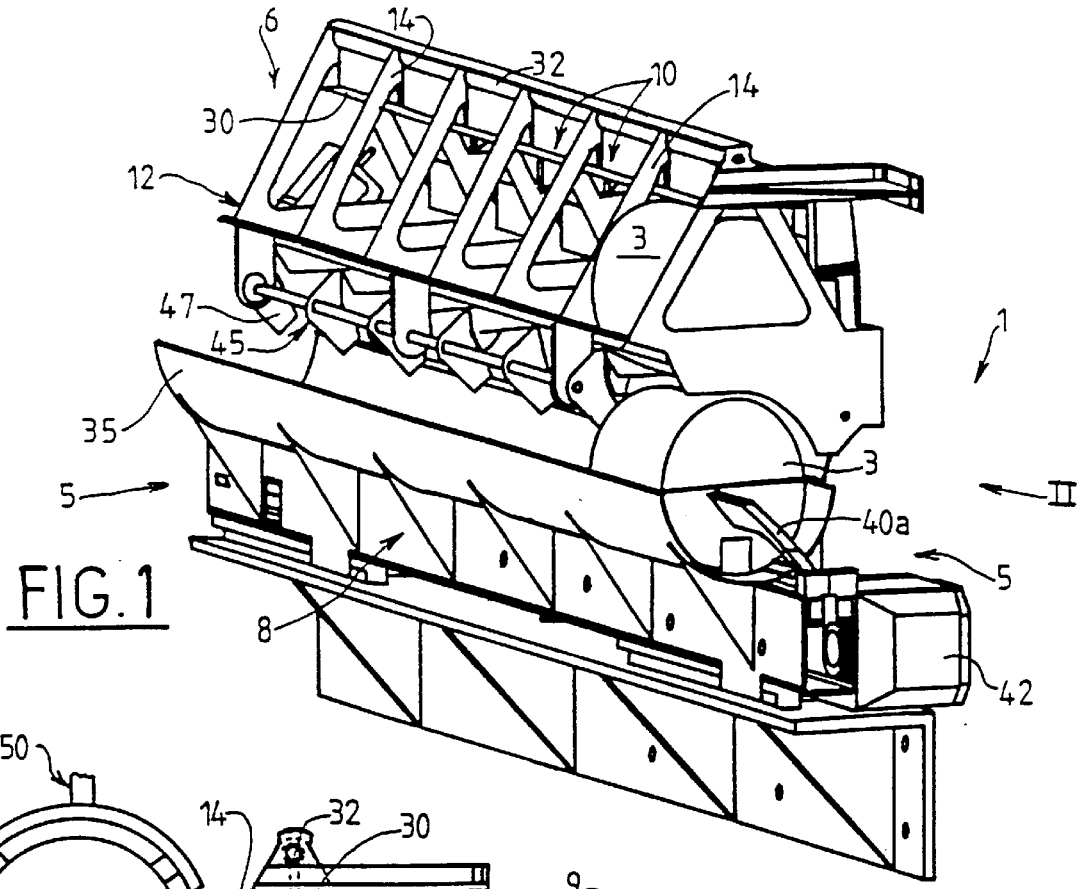
FIG. 1 is a perspective view of the transfer apparatus of a first embodiment of the invention.

As shown in FIG. 1, the transfer apparatus 1 for transferring modules 3 that make up propellant charges is designed to be mounted between a storage magazine (not shown) and a loading system 5 for loading the modules 3 into a chamber of a large-caliber gun barrel (not shown) for the purposes of firing a projectile that is inserted into the chamber prior to the modules.

The transfer apparatus 1 essentially comprises:

first means 6 for receiving n modules 3 taken from the magazine;

second means 7 for transferring each of the modules 3 to a conveyor 8 of the loading system 5; and control apparatus 9 for controlling the second means 7 so as to select transferal of a determined number of the n charges to the conveyor 8.

The first means 6 for receiving the modules 3 comprise a set of n compartments 10 which are provided in a longitudinal unit 12 so as to form a line or a row for receiving n modules 3 in axial alignment along the row. Each compartment 10 is delimited between two end partitions 14 that are vertical and mutually parallel. The two partitions 14 of a compartment 10 are spaced apart from each other by a distance that is slightly greater than the length of a module 3.

The partitions make it possible to separate the various modules, thereby preventing the modules from rubbing together which might initiate their powder load.

In general, each compartment 10 includes an abutment surface 15 for retaining the module 3. In a preferred embodiment, the module 3 received in a compartment 10 is transferred by gravity onto the conveyor 8 of the loading system 5. For this purpose, the abutment surface 15 is formed by the curved edge 17*a* of a flap 17 that is mounted to move by means of an actuator 20 between an active position in which it retains the module 3 in the compartment 10 and a retracted position in which it then releases the module 3 onto the conveyor 8 by gravity. Therefore, at each compartment, the abutment surface 15 of the flap 17 forms the second means 7 for transferring the module 3 to the conveyor 8.

Figure 2:
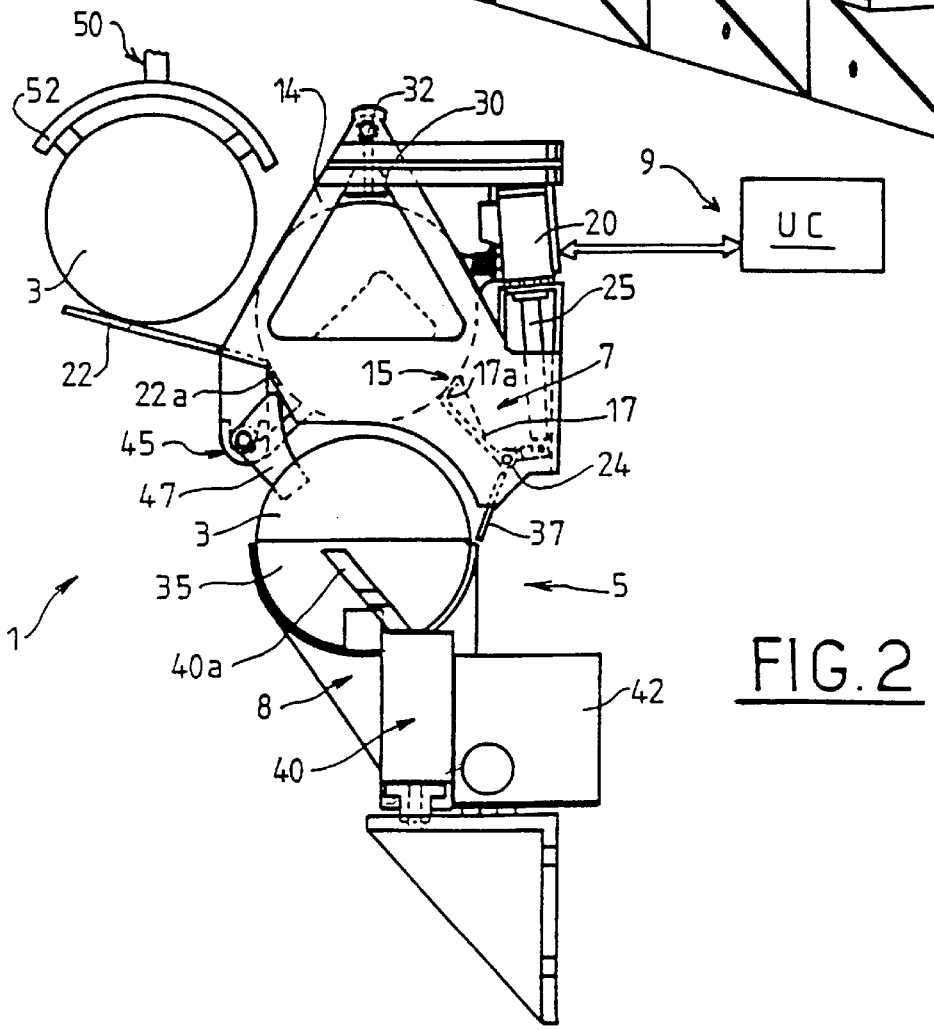
FIG. 2 is a view looking along arrow II of FIG. 1.

In the example shown in FIG. 2, the abutment surface for the module 3 in a compartment 10 is supplemented by a fixed portion formed by a curved edge 22*a* of a plate 22. The plate 22 extends substantially over the entire length of the longitudinal unit 10, and parallel thereto to form an abutment and guide surface for the modules 3 at the inlets of the compartments 10. The plate 22 slopes down towards the compartments 10 so as to form a sloping surface enabling the modules 3 to roll down into their respective compartments 10 once they have been deposited on the plate 22. The edge 22*a* of the plate 22 is curved downwards and is situated on the side of the plate that is adjacent to the compartments 10.

The flap 17 is situated in the vicinity of the back of each compartment 10 and such that, when the flap 17 is in its active position, its curved portion 17*a* is substantially at the same level as the edge 22*a* of the plate 22 and situated at a distance therefrom that is less than the diameter of a module 3.

A module 3 can thus rest freely on the two edges 22*a* and 17*a*. In practice, when the flap 17 is in its active position, it lies in a sloping position.

At its end opposite from its curved edge 17*a*, each flap 17 is hinged firstly to a pin 24 supported by the unit 12 and secondly to a rod 25 of the associated actuator 20 which is also supported by the unit 12. For example, each actuator 20 may be of the electromagnetic type.

A module 3 received in a compartment 10 is chocked by means of a hinged pad 30 which comes into position just above the module 3. All of the pads 30 are carried by a common rod 32 so that they are controlled simultaneously by being pivoted by means of a drive member (not shown) which rotates the rod 32 back and forth. Each pad 30 can thus either take up an active position so as to chock the module 3 in its compartment 10, or a retracted position so as not to prevent the module 3 from entering its compartment 10.

The control apparatus for controlling all of the actuators 20 of the flaps 17 is constituted by a central processing unit (CPU) and by means for counting the number of modules 3 transferred onto the conveyor 8.

The conveyor 8 of the loading system 5 comprises a trough 35 which is designed to receive the modules 3 that fall by gravity from the compartments 10. The trough 35 is placed below the compartments 10 and it extends over the entire length thereof. Additional guide surfaces 37 are provided between the compartments 10 and the trough 35 to guide the modules 3 while they are falling. The conveyor 8 is also equipped with a ramrod 40 actuated by a drive member 42. The ramrod 40 is situated in the vicinity of one end of the trough 35 and it includes a head 40a serving to bear against the module 3 situated at the end of the trough 3 so as to push the set of modules 3 onto a cradle of a loading arm (not shown).

Advantageously, the modules 3 received in the trough 35 are separated from one another by means of a comb 45 whose teeth 47 engage between the modules 3. The comb 45 can be retracted by means of a drive member (not shown) before the ramrod 40 is actuated. The comb makes it possible to prevent the modules from rubbing together which might ignite them.

In practice, and with reference to FIG. 2, a hinged arm 50 equipped with pick-up means 52, e.g. of the suction type, takes a row of modules 3 from the outlet of the magazine. The arm 50 is then displaced so as to deposit the row of modules 3 on the sloping surface formed by the plate 22 situated at the inlets of the compartments 10. The flaps 17 of all of the compartments 10 are then in the active position so that their respective abutment surfaces 15 can retain the modules 3, whereas the pads 30 are then in a retracted position so as to enable said modules 3 to pass freely. Thus, once they are released by the arm 50, the modules 3 roll on the sloping surface formed by the plate 22 and penetrate freely into their respective compartments 10. The pads 30 are then brought into an active position to chock the modules 3 in their respective compartments 10.

It is assumed that the arms 50 take six modules, that there are also six compartments 10, and that the desired propellant charge for firing a projectile needs four modules 3 to be loaded.

Under these conditions, the chief gunner enters the above parameters into the central processing unit CPU so that four actuators 20 only are actuated, thereby bringing the flaps 17 associated with said actuators 20 into a retracted position. Four modules 3 are thus received by the trough 35 of the conveyor 8 between the teeth 47 of the-comb 45. After the comb 45 has been raised, the trough 35 is displaced towards the loading cradle, and the ramrod 40 then pushes the four modules 3 onto the cradle so that they can be loaded into the chamber of the barrel for firing a first projectile.

The trough 35 is returned to its initial position below the row of compartments 10, the comb 45 is lowered and the two actuators 20 associated with the two compartments 10 still containing modules 3 are actuated so that the two modules 3 are received by the trough 35.

The hinged arm 50 is operated to insert six new modules 3 into the six compartments 10. The central processing unit CPU then controls two actuators 20 so that two new modules are received in the trough 35, thereby obtaining the quantity of propellant charge required for firing a second projectile. Naturally, the two actuators 20 are selected so as to choose two compartments 10 different from those that contain the two modules 3 already received by the trough 35. The four modules in the trough 35 are then pushed towards the loading cradle.

Then, the four actuators 20 of the four compartments 10 still containing modules 3 are controlled by the central processing unit CPU, and four modules 3 are received in the trough 35. Said four modules can then be pushed towards the loading cradle because their number corresponds to the propellant charge required to fire a third projectile. The above cycle is repeated for firing subsequent projectiles.

Naturally, the invention is not limited to the above-described embodiment. In particular, the pads 30 which enable the modules 3 to be chocked in the compartments 10 are not necessarily controlled by a drive member. The pads 30 may be lifted or pushed away as the modules 3 go past, and then fall back merely by gravity when the modules 3 leave the compartments 10.

FIGS. 3 to 5*b* show a second embodiment of the transfer apparatus of the invention.

In this embodiment, the first means 6 for receiving the propellant charge modules 3 also comprise n compartments 10 provided in a longitudinal unit 12. Each compartment 10 is delimited by two end partitions 14 that are vertical, mutually parallel, and triangular in shape, which facilitates lowering of the pick-up means (not shown in these figures), such as tongs, that transport the module from the magazine to the compartment. The bottom of each compartment is formed by a bottom plate 64 against which the module abuts.

The partitions enable the various modules to be separated from one another, thereby preventing them from rubbing together which might cause them to be initiated.

The various compartments are in line so as to form a row for receiving the modules 3.

The longitudinal unit constitutes an all-welded support structure also carrying the trough 35 of the conveyor, which trough is disposed on one side of the row of compartments 10 and parallel thereto, the bottom of the trough lying slightly below the bottom plate 64.

The transfer apparatus also includes a pusher 60 at each compartment 10, which pusher can be moved in translation in a first direction Z perpendicular to the axis of the module 3.

The set of pushers constitute the second means enabling each of the modules to be transferred to the conveyor of the loading system.

Each pusher 60 is constituted by an L-shaped plate 61 against which the charge module 3 abuts, which plate carries two triangular stiffeners 62.

The plate 61 is secured to a driving bar 63 which is disposed below the compartment 10. The bar 63 includes an end on which the pusher is fixed, which end passes through the bottom plate 64 via a slot 65. The bar 63 is mounted to slide relative to the compartment 10 by means of guide grooves (not shown).

The driving bar 63 carries a rack 67 engaged by a pinion 68 driven by a motor 69. The motor 69 is controlled by the central processing unit, and it causes the bar 63 and the pusher 60 to be displaced in the direction Z.

A top face of the bar 63 is provided with a notch 70 which serves to co-operate with a rod 71 whose axis is parallel to the axis of the module 3.

The rod 71 is secured to two retractable chocking fingers 72 which constitute side chocking means for chocking each module in the first direction Z perpendicular to the axis of the module.

In their chocking position, the fingers 72 thus hold the module 3 in its compartment 10 and they prevent the module 3 from rolling into the trough 35 of the conveyor.

The set formed by the fingers 72 and the rod 71 can pivot about bearings 73 secured to the support 12.

The notch 70 has two sloping profiles 70a and 70b.

The first profile 70*a* slopes such that by displacing the pusher in the direction Z, the fingers 72 tilt and are retracted below the bottom plate 64 of the compartment. This tilting releases the module 3 which can then be pushed into the trough 35 by the pusher 60.

The second profile 70*b* slopes such that by returning to its initial position, the pusher repositions the fingers in their module-chocking position. Returning the fingers to their initial position may optionally be assisted by a return spring.

At each compartment, the transfer apparatus of the invention also includes means for holding each module 3 in a second direction Y which is perpendicular both to the axis of the module and to the first direction Z.

These holding means comprise at least one first retractable tab 74 which is mounted between the end partitions 14 that delimit a compartment 10.

The tab 74 can pivot against the action of a return spring 79 about an axis 75 parallel to the axis of the module 3. The first tab 74 is in the rest state in the position shown in FIG. 5*a*, in which position it is in abutment and can rotate about the axis 75 counter-clockwise only.

When a charge module 3 is inserted into the compartment 10, the first tab 74 is pushed by the module. Once the module is in its compartment, the first tab 74 is returned to its rest position by its return spring.

It then prevents the module 3 from leaving its compartment 10 in direction Y.

At each compartment 10, the apparatus also includes a second retractable tab 76 which is mounted on the same axis 75 as the first tab, and which is interposed between the compartment 10 and the trough 35 of the conveyor.

The second tab can also pivot against the action of a return spring 80.

Figure 5A:
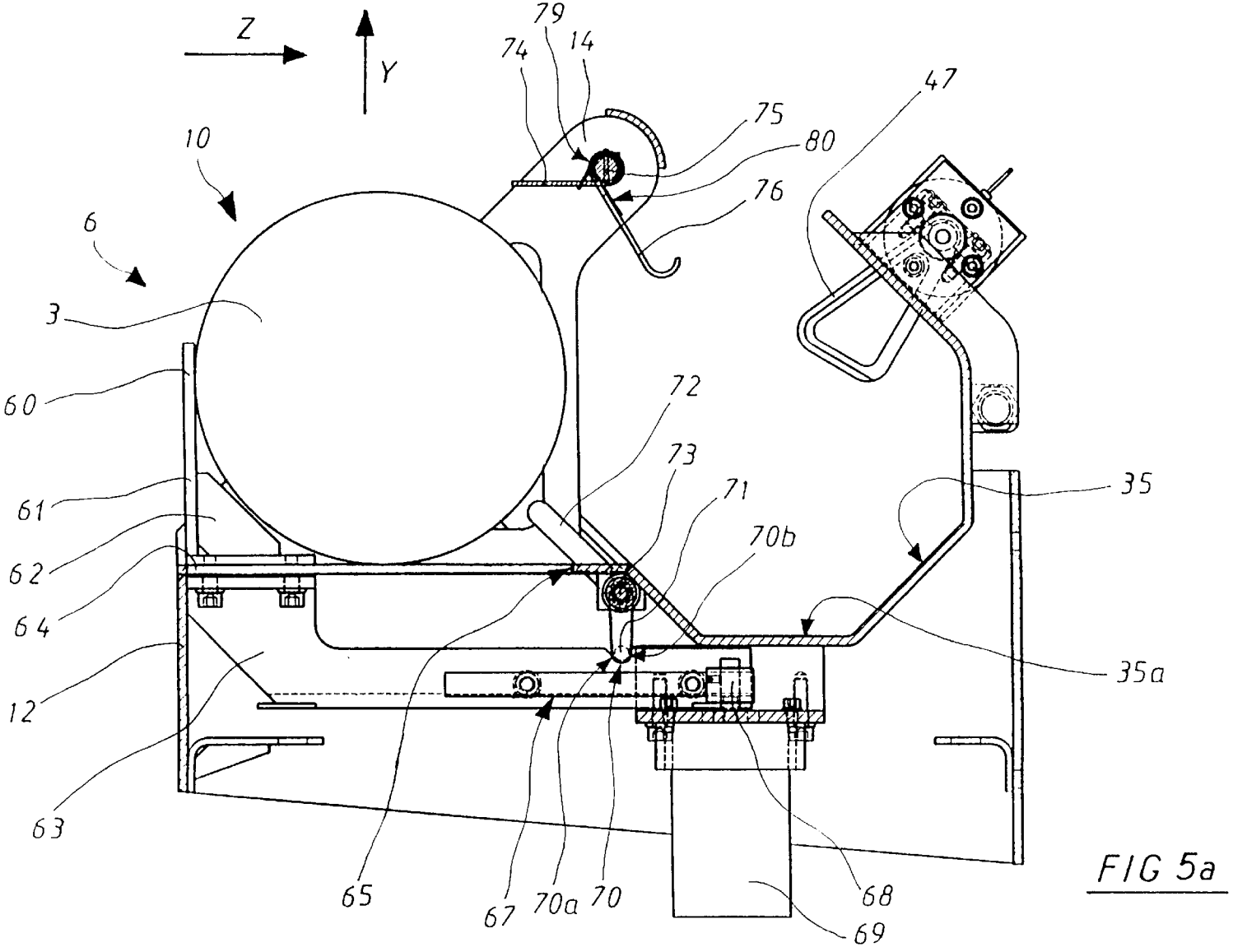
FIGS. 5*a* and 5*b* are cross-sections through the second transfer apparatus, taken at a compartment and on a plane that is perpendicular to the axis of a charge module, FIG. 5*a* showing the apparatus when a propellant charge module is in a compartment of the module-receiving means, and FIG. 5*b* showing the same apparatus once the module has been transferred to the conveyor.
Figure 5B:
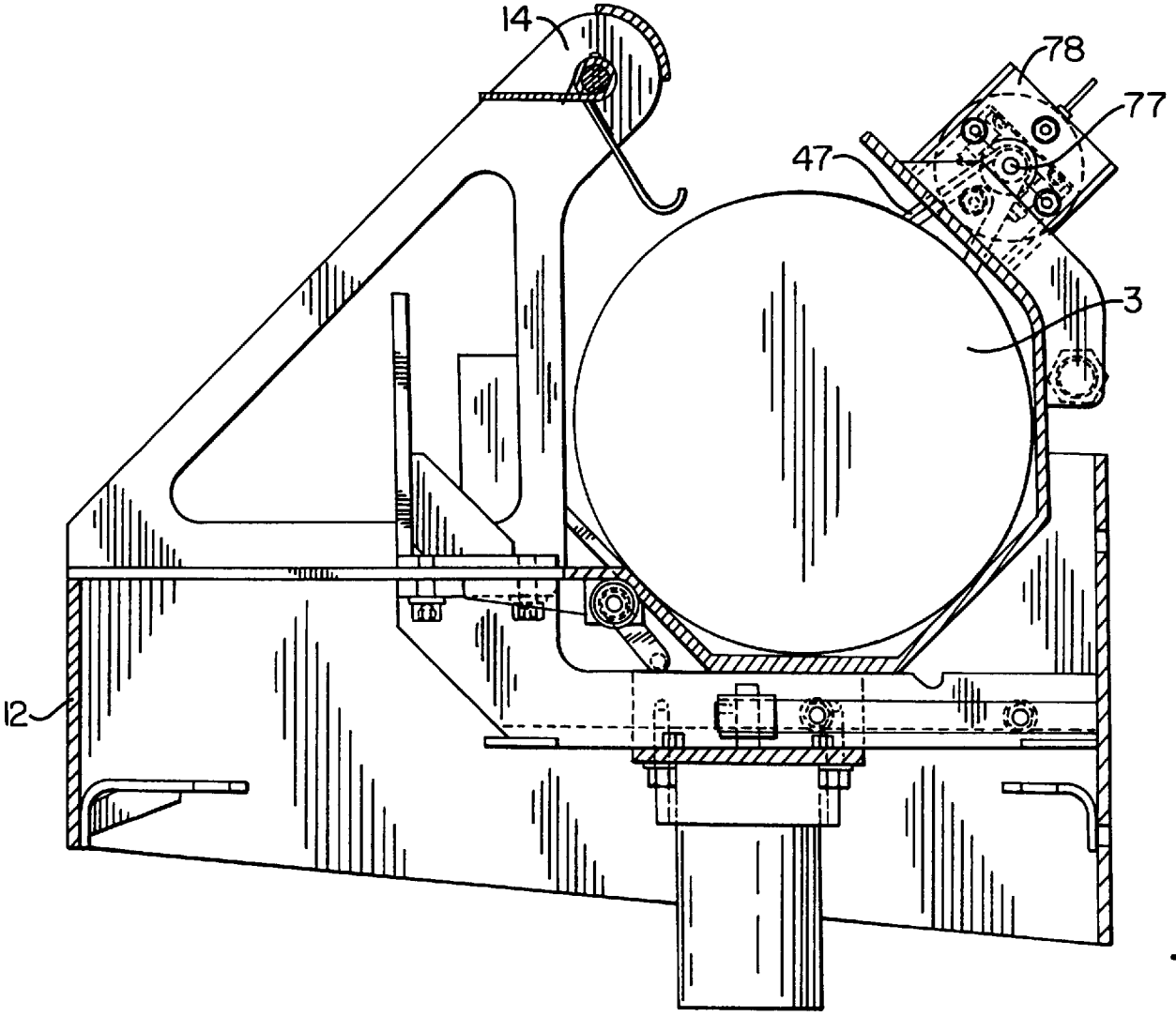

It is in the rest state in the position shown in FIG. 5*a*, in which position it is in abutment and can rotate about the axis 75 counter-clockwise only.

When the module 3 is pushed into the trough 35 by the pusher 60, the second tab is pushed by the module. Once the module 3 is in the trough 35, the second tab 76 is returned to its rest position by its return spring.

It then prevents the module 3 from returning to the compartment 10. This is also prevented by the position of the bottom 35*a* of the trough, which bottom is disposed below the bottom plate 64.

As in the preceding embodiment, the modules 3 that are received in the trough 35 are separated from one another by means of a comb 45 which prevents them from rubbing together.

The comb includes teeth 47 which are secured to an operating pin 77 which is rotated by a drive member 78.

The comb is retracted prior to actuating a ramrod (not shown) which may have a structure analogous to the structure of the ramrod described with reference to FIGS. 1 and 2, and which, for example, includes a head serving to bear against the charge module situated at the end of the trough, and enabling the set of modules to be pushed onto the cradle of a loading arm.

The transfer apparatus operates as follows.

As in the preceding embodiment, an arm (not shown) equipped with grasping means deposits a row of modules 3 in the compartments 10. A sloping plate may optionally be positioned above the pushers 60 to direct the modules towards the compartments.

Figure 3:
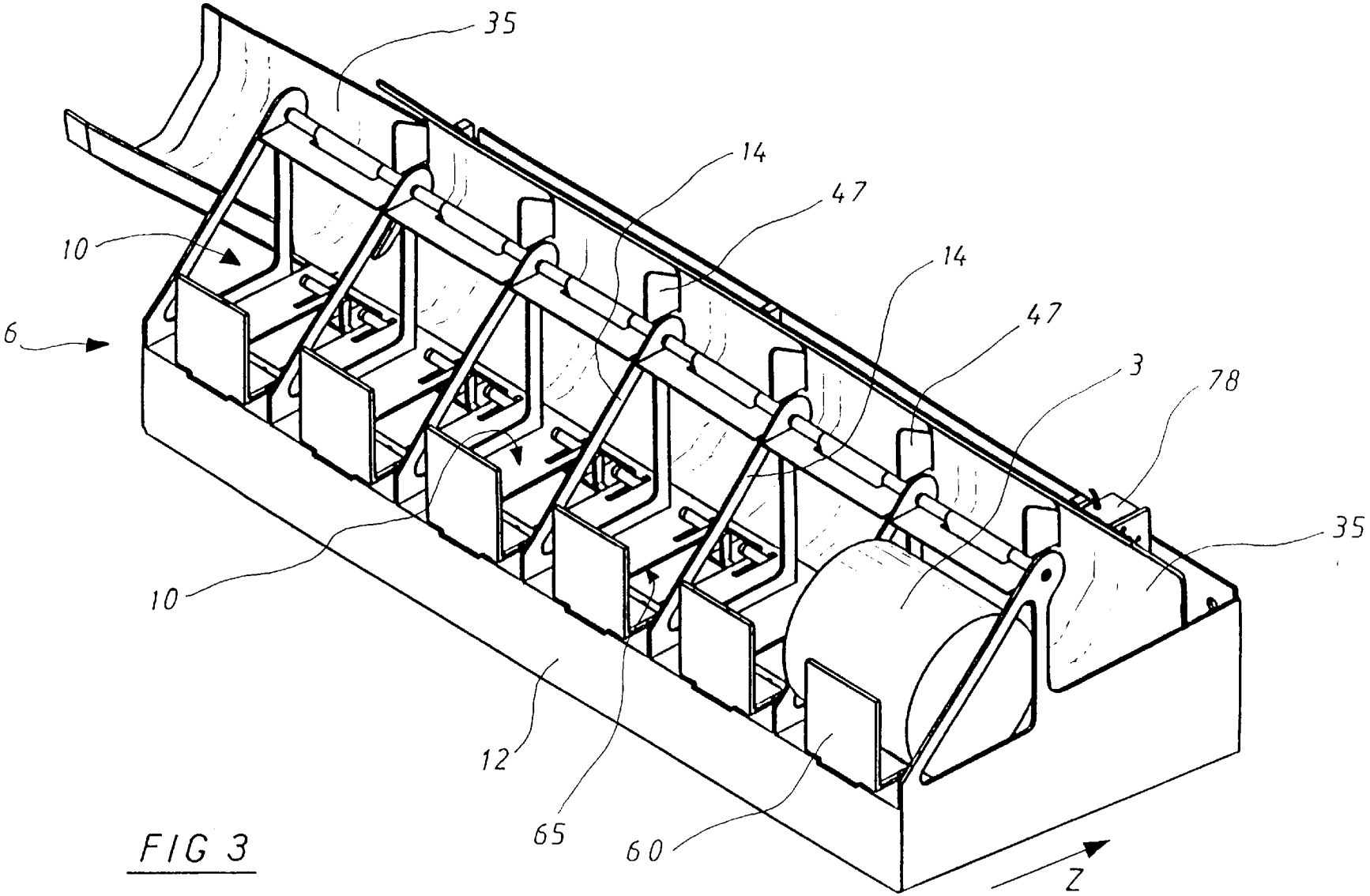
FIG. 3 is a first perspective view of the transfer apparatus of a second embodiment of the invention.
Figure 4:
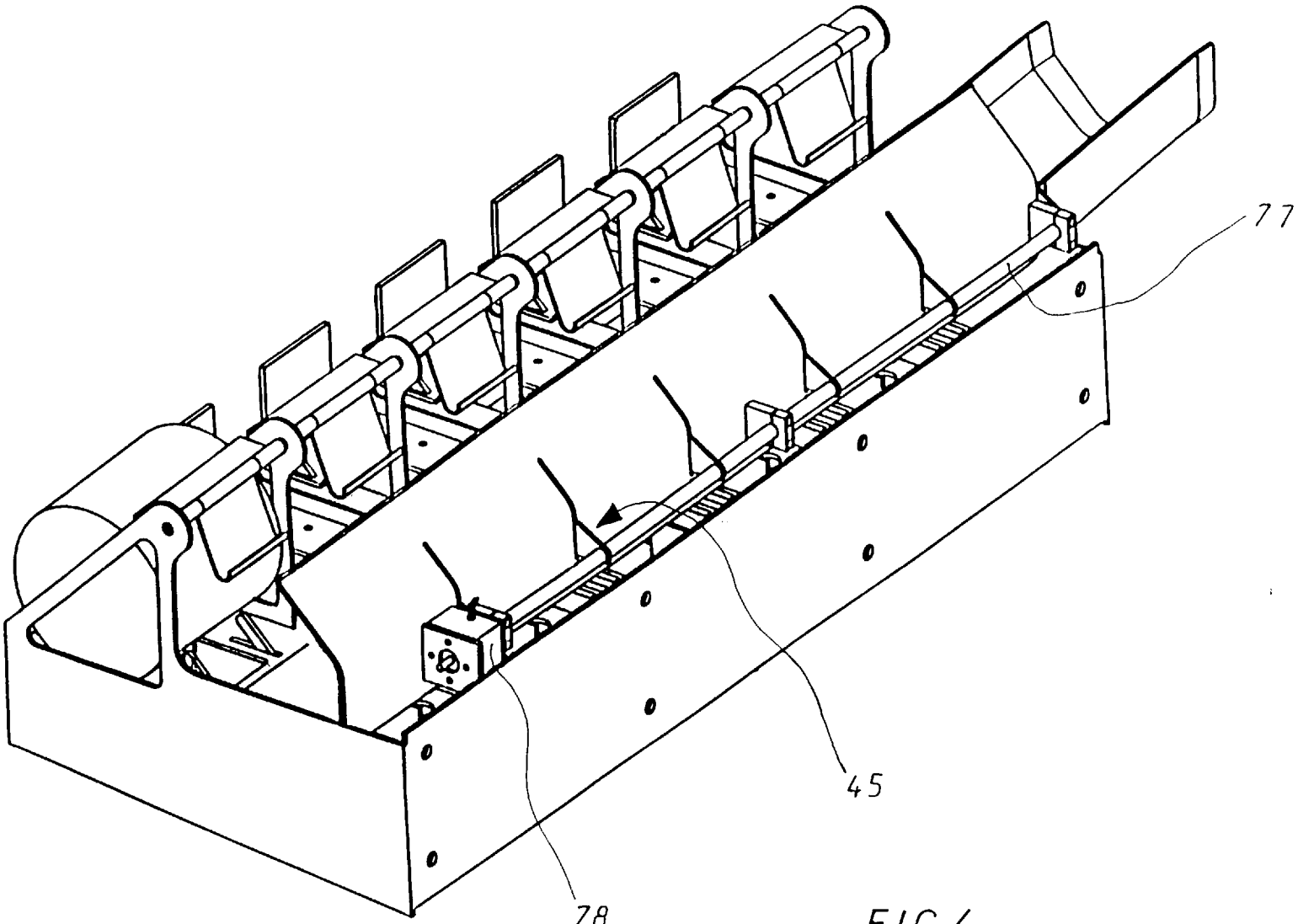
FIG. 4 is a second perspective view of the second apparatus, looking in the direction indicated by arrow F in FIG. 3.

All of the pushers 60 are in their reception position as shown in FIGS. 3 and 4.

Each module is then held horizontally in its compartment 10 between the plate 61 and the chocking fingers 72. It is also held in the vertical direction by the first flap 74.

As a function of the firing parameters, the chief gunner enters into the central processing unit CPU the desired number of modules. Thus, only some of the motors 69 are controlled to cause their associated pushers to be displaced.

Each pusher that is actuated pushes a propellant charge module into the trough 35 between the teeth 47 of the comb 45. After the comb 45 has been raised, the ramrod can push the modules onto a loading cradle.

After this initial loading, and depending on the number of modules remaining in the compartments, there are two possibilities:

If enough modules remain in the compartments 10 to make up the new desired charge, the necessary number of modules are transferred to the trough 35 by the appropriate pushers.

If there are not enough modules to make up the new planned charge, the remaining modules are transferred to the trough 35 to enable the compartments 10 to be refilled. Then the additional number of modules required to make up the desired total number are transferred to the free locations in the trough 35 by the appropriate pushers. Naturally, the control unit chooses the pushers 60 that correspond to compartments 10 other than those which contain the modules already received by the trough 35.

Once the charge has been made up in the trough 35, the comb 45 is raised and the ramrod pushes the modules onto a loading cradle. The cycle can be repeated for firing subsequent projectiles.

The advantage of the second embodiment is that it is more compact vertically than the first embodiment.

The choice of the embodiment used is made as a function of the available space in the gun turret.

Various variants are possible without going beyond the ambit of the invention.

It is thus possible to give various shapes to the means for driving the pushers, to the chocking fingers, and to the holding flaps.

We claim:

1. Apparatus for transferring modules that make up propellant charges from a storage magazine to a loading system for loading the modules into a chamber of a large-caliber gun barrel said apparatus including:

first means for receiving n modules taken from said magazine, said first means comprising n compartments, with each compartment being delimited by two vertical end partitions, which partitions separate the modules from one another;

second means for transferring each of the n modules to a conveyor; and control apparatus for controlling the second means so as to select transferal of a determined number of modules to the conveyor as a function of the quantity of modules making up the desired propellant charge for firing a projectile.

2. Transfer apparatus according to claim 1, wherein the second means comprise, at each compartment of the first means, an abutment surface carried by a flap mounted to pivot and to be displaced by means of an actuator between an active position in which it retains the module and a retracted position in which it releases the module onto the conveyor.

3. Transfer apparatus according to claim 2, wherein the compartments for receiving the modules are disposed in a row, and wherein the conveyor comprises a trough disposed beneath the row of compartments and parallel thereto.

4. Transfer apparatus according to claim 3, wherein the conveyor also includes a ramrod for pushing the modules received in a trough.

5. Transfer apparatus according to claim 4 wherein the conveyor comprises means for separating the modules received in the trough from one another, which means can be retracted prior to actuating the ramrod.

6. Transfer apparatus according to claim 5, wherein the separation means are constituted by a comb extending parallel to the trough, the teeth of the comb separating the modules.

7. Transfer apparatus according to claim 2, wherein the compartments of the first means are provided in a longitudinal unit.

8. Transfer apparatus according to claim 2, wherein the control apparatus for controlling the second means comprises a central processing unit for controlling the acutuator of each compartment of the first means as a function of the quantity of modules making up the desired propellant charge, and means for counting the number of modules transferred to the conveyor.

9. Transfer apparatus according to claim 1, wherein the second means comprise, at each compartment of the first means, a pusher that can be moved in translation in a first direction (Z) which is perpendicular to the axis of the module so as to push said module onto the conveyor.

10. Transfer apparatus according to claim 9, including, at each compartment of the first means, side chocking means for chocking each charge module in the first direction (Z) that is perpendicular to the axis of the module, which means comprise at least one retractable finger disposed between the module and the conveyor, and moved out of the way by displacing the pusher.

11. Transfer apparatus according to claim 9 including, at each compartment, means for holding each charge module in a second direction (Y) perpendicular both to the axis of the module and to the first direction (Z), which means comprise at least one first retractable tab which is moved out of the way by the module as it enters the compartment and which is returned to a holding position by the action of spring means.

12. Transfer apparatus according to claim 9, including means for holding each module in the conveyor, which means comprise at least one second retractable tab disposed between each compartment and the conveyor, which tab is moved out of the way by the module as it enters the conveyor, and is returned to its holding position under the action of spring means.

13. Transfer apparatus according to claim 9, wherein the compartments for receiving the modules are disposed in a row, and wherein the conveyor comprises a trough disposed on one side of the row of compartments and parallel thereto.

14. Transfer apparatus according to claim 13, wherein the compartments and the trough are secured to a common support structure.

15. Transfer apparatus according to claim 12, wherein the conveyor also includes a ramrod for pushing the modules received in the trough.

16. Transfer apparatus according to claim 15, wherein the conveyor comprises means for separating the modules received in the trough from one another, which means can be retracted prior to actuating the ramrod.

17. Transfer apparatus according to claim 16, wherein the separating means comprise a comb extending parallel to the trough, with the comb comprising teeth that separate the modules.

18. Transfer apparatus according to claim 9, wherein the compartments of the first means are provided in a longitudinal unit.

* * * * *

UNITED STATES PATENT AND TRADEMARK OFFICE

CERTIFICATE OF CORRECTION

PATENT NO. : 5,837,923

DATED : November 17, 1998

INVENTOR(S) : Gay et al.

It is certified that error appears in the above-identified patent and that said Letters Patent is hereby corrected as shown below:

Column 10, line 8, "claim 12" should read --claim 13--.

Signed and Sealed this

Twenty-third Day of March, 1999

*Attest:*

Q. TODD DICKINSON

*Attesting Officer*

*Acting Commissioner of Patents and Trademarks*